US006868910B2

(12) United States Patent
Corre et al.

(10) Patent No.: US 6,868,910 B2
(45) Date of Patent: Mar. 22, 2005

(54) METHOD AND DEVICE FOR REGULATING THE FLOW RATE OF FORMATION FLUIDS PRODUCED BY AN OIL WELL

(75) Inventors: Pierre-Yves Corre, Montford-sur-Meu (FR); James Leighton, L'Hermitage (FR); Barry Nicholson, Carindale (AU); Jean Louis Saltel, Le-Rheu (FR)

(73) Assignee: Schlumberger Technology Corporation, Sugarland, TX (US)

( * ) Notice: Subject to any disclaimer, the term of this patent is extended or adjusted under 35 U.S.C. 154(b) by 0 days.

(21) Appl. No.: 10/258,881

(22) PCT Filed: Apr. 27, 2001

(86) PCT No.: PCT/EP01/04870

§ 371 (c)(1),
(2), (4) Date: Jan. 31, 2003

(87) PCT Pub. No.: WO01/83943

PCT Pub. Date: Nov. 8, 2001

(65) Prior Publication Data

US 2003/0145992 A1 Aug. 7, 2003

(30) Foreign Application Priority Data

May 3, 2000 (FR) ..... 00 05664

(51) Int. Cl.[7] ..... E21B 43/12; E21B 43/14

(52) U.S. Cl. ..... 166/313; 166/206; 166/242.1; 166/316; 166/386

(58) Field of Search ..... 166/369, 316, 166/386, 313, 206, 207, 242.1

(56) References Cited

U.S. PATENT DOCUMENTS 3,477,506 A * 11/1969 Malone ..... 166/207
4,382,470 A * 5/1983 Naffziger ..... 166/369
5,186,255 A 2/1993 Corey
5,211,241 A 5/1993 Mashaw, Jr. et al.
5,896,928 A 4/1999 Coon
6,478,091 B1 * 11/2002 Gano ..... 166/373
6,527,049 B2 * 3/2003 Metcalfe et al. ..... 166/277
2002/0066578 A1 * 6/2002 Broome ..... 166/386

FOREIGN PATENT DOCUMENTS

GB 2325949 A 9/1998
WO WO 94/25655 11/1994

OTHER PUBLICATIONS

International Search Report from corresponding PCT application No. PCT/EP01/04870.

* cited by examiner

*Primary Examiner*—Hoang Dang
(74) *Attorney, Agent, or Firm*—Robin Nava; Brigitte L. Echols

(57) ABSTRACT

The present invention relates to a method of regulating the flow rate of formation fluids produced from a determined zone of an underground well whose cased wall is provided with orifices through which said formation fluids can pass, said method consisting in applying a tubular structure along the casing in said zone, which tubular structure prevents the fluids from flowing directly while also preserving a flow path along which the fluids can flow via the annular space outside the tubular structure so as to generate head loss. The invention also relates to a device for implementing said method, which device is essentially constituted by a radially-expandable tubular structure that can be applied against the inside wall of the casing, the structure being provided with means for preserving the flow of the fluids via a path running along the casing and along the structure, in order to generate head loss.

9 Claims, 4 Drawing Sheets

5_A 5_B 5_C 5_D

METHOD AND DEVICE FOR REGULATING THE FLOW RATE OF FORMATION FLUIDS PRODUCED BY AN OIL WELL

The present invention relates to completion techniques used when starting production from a deposit of hydrocarbons, of gas, of water, or the like, and it relates more particularly to means for regulating the production flow rate from certain zones of an oil well or the like.

Generally, formation fluids, i.e. hydrocarbons, water, and gas, are extracted from a deposit by means of a borehole consolidated by mechanical casing cemented to the wall of the borehole. In zones that pass through underground reservoirs, the casing and the layer of cement are perforated to put the formation fluids in communication with the inside of the well.

A well usually passes through a plurality of production zones of various thicknesses, and it therefore includes different perforation zones. The formation fluids are conveyed to the surface by means of production tubing. The production tubing is centered relative to the casing, and is held by a packer, thereby making it possible to isolate the fluid production zone from the upper portion of the well.

Because of the diversity of the soils and of the quality of the rocks through which the well passes, it is common for the various perforation zones in the well to produce differently, be it in terms of flow rate or in terms of quality of the fluid produced. Certain zones can produce more than others and/or the ratio between the quantity of hydrocarbons produced and the quantity of water produced can vary from one zone to another. The same well might thus include zones that produce 80% water and 20% oil, the water and the oil flowing together at a flow rate of 500 barrels per day (500 bbl=79.3 $m^3$), whereas an adjacent zone might produce a higher quantity of hydrocarbons, e.g. 30% oil, but at a lower flow rate.

Since the flow rate is a function of the pressure difference between the formation and the well, the proximity of a high flow rate zone tends to reduce said pressure difference and thus to minimize the quantity actually produced by a lower flow rate zone.

Unfortunately, high flow rate zones are often zones that mainly produce large quantities of water, or more precisely of brine that is unsuitable for any use and that must be separated from the hydrocarbons and that must be disposed of, e.g. by being re-injected into a neighboring well. Such unwanted production is particularly troublesome in that it limits the total output of hydrocarbons. It should also be emphasized that the production flow rates and qualities of the various zones also vary over the life of the well.

Various techniques are known for plugging perforations, e.g. by injecting a gel or a cement into the zones to be treated, or by placing a sealing liner inside the casing. Thus, tubular preforms have been proposed, designed to be put in place while they are in the folded state, in which they are relatively compact radially, and then to be unfolded to obtain a cylindrical shape whose outside diameter is close to the inside diameter of the casing. It is also known, in particular from Document WO 94/25655, that a tubular preform can be constituted by a braid of flexible strands embedded in a resin that can be set under the effect of heat, for example. That type of preform accommodates very high degrees of expansion, thereby making it possible to insert the preform through the production tubing, and thereby minimizing the costs of working over and restarting production.

All those techniques suffer from the drawback of totally stopping any production from the treated zone, which can adversely affect the total output from the well.

An object of the present invention is thus to provide means for regulating the flow rate of the zones to be treated, but without thereby eliminating said flow rate. The invention achieves this object by making provision to apply a tubular structure along the cased wall of a well, in the perforation zone to be treated, which tubular structure prevents the fluids from flowing directly while also preserving a flow path along which the fluids can flow via the annular space outside the tubular structure so as to generate head loss.

The invention also provides a device for reducing the flow rate of formation fluids produced from a determined zone of an underground well, which device is essentially constituted by a radially-expandable tubular structure that can be applied against the inside wall of the casing, the structure being provided with means for preserving the flow of the fluids via a path running along the casing and along the structure, in order to generate head loss. In other words, the tubular structure of the invention does not serve to plug the perforations of the casing, but rather merely to slow down the flow of the formation fluids at the treated perforations.

In a more particularly preferred variant of the invention, these flow means are constituted by grooves extending from the central portion of the outside face of the tubular structure to at least one of the ends of the tubular structure, which grooves preferably extend helically or in the form of zigzag lines.

In a more particularly preferred embodiment, the tubular structure is derived from the tubular structure taught by above-mentioned Document WO 94/25655, and it is thus formed of a tubular sleeve constituted by a braid of flexible strands embedded in a settable composite material, and, on its outside face, it has an elastomer skin provided with grooves forming a flow path extending from the central portion of the outside face that serves to cover the perforation orifices to at least one of the ends of the sleeve.

Finally, the invention also provides a method for putting the device of the invention in place.

Other details and advantageous characteristics of the invention appear from the following description given with reference to the figures, in which.

Figure 1:
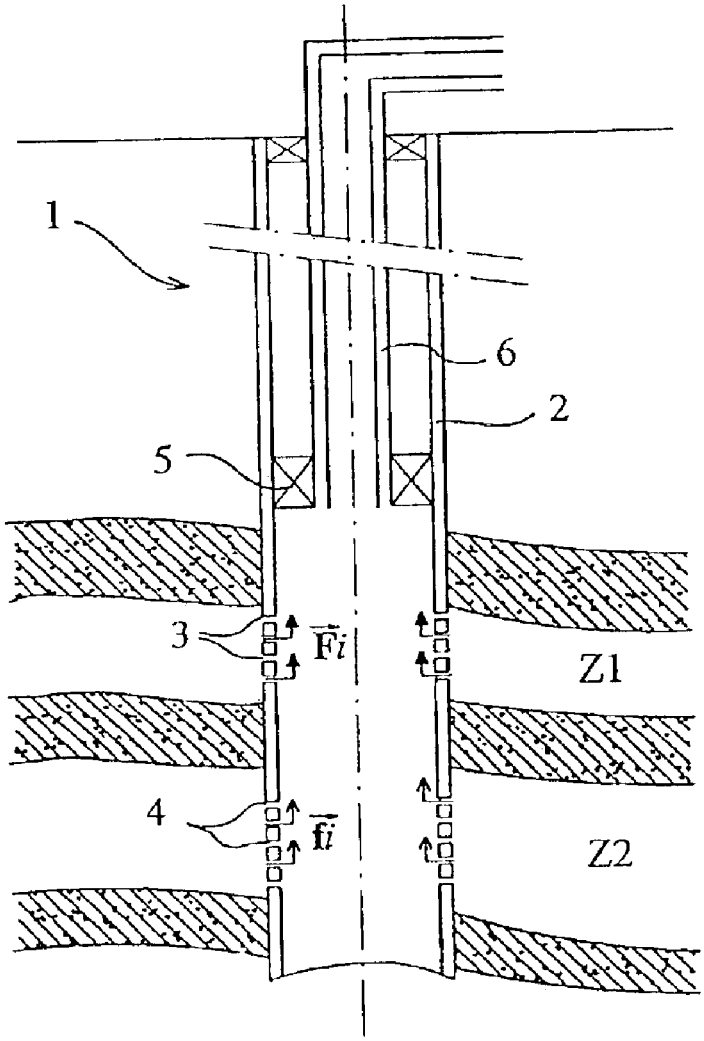
FIG. 1 is a diagrammatic axial section view of an oil well passing through two perforation zones, one of which can be treated by the flow rate regulation method of the invention.

FIG. 1 shows a typical oil well that can benefit from the method of the invention. This well is formed by a borehole 1 which, in this example, extends along an essentially vertical axis, and whose wall has been cased by means of metal casing 2 fixed to the wall by means of a layer of cement. Starting from the surface, the well passes through a large number of types of geological formation that are isolated by the casing.

In the zones capable of producing hydrocarbons, the casing and the cement layer situated in the annular space between the casing and the wall of the borehole are perforated by means of explosive charges in order to re-establish the communication between the formation and the well, and in order to enable the fluids from the formations Z1 and Z2 to enter the well via the perforations 3 and 4.

The top portion of the well is isolated from the production zones by means of a packer 5 which maintains production tubing 6 centered in the casing; which tubing is smaller than the casing and conveys the fluids produced by the formations Z1 and Z2 to the surface. By way of example, the casing has a mean diameter lying in the range 110 mm to 180 mm (4½ inches to 7 inches) and the production tubing has a diameter Dt typically lying in the range 55 mm to 160 mm (2⅛ inches to 6¼ inches).

It is frequent for the production zones to have heterogeneous flow rates. For example, the production zone Z1 can produce a flow rate $\vec{F}_i$ of 500 barrels per day (0.9 liters per second) of a fluid made up of 80% water and of 20% oil, with as a "driving force" a pressure differential between the formation and the inside of the well of about 100 psi (6.9 MPa), while the production zone Z2 produces a flow rate $\vec{f}_i$ of about 400 barrels per day (0.7 liters per second) of a fluid made up of 30% water and of 70% oil for a pressure differential of the same order of magnitude.

In order to increase the flow rate of the zone Z2 that is richer in hydrocarbons, it is possible to close off the perforations of the zone Z1. However, the operations performed to plug the perforations are not easily reversible, so that it would probably be difficult to access the zone Z1 subsequently to enable the well to produce effectively until it is depleted.

The present invention proposes to increase the head loss in the zone Z1 of lesser interest in order to increase the pressure differential in the zone Z2 that is richer in hydrocarbons, but while maintaining a certain level of production from the zone Z1.

Figure 2:
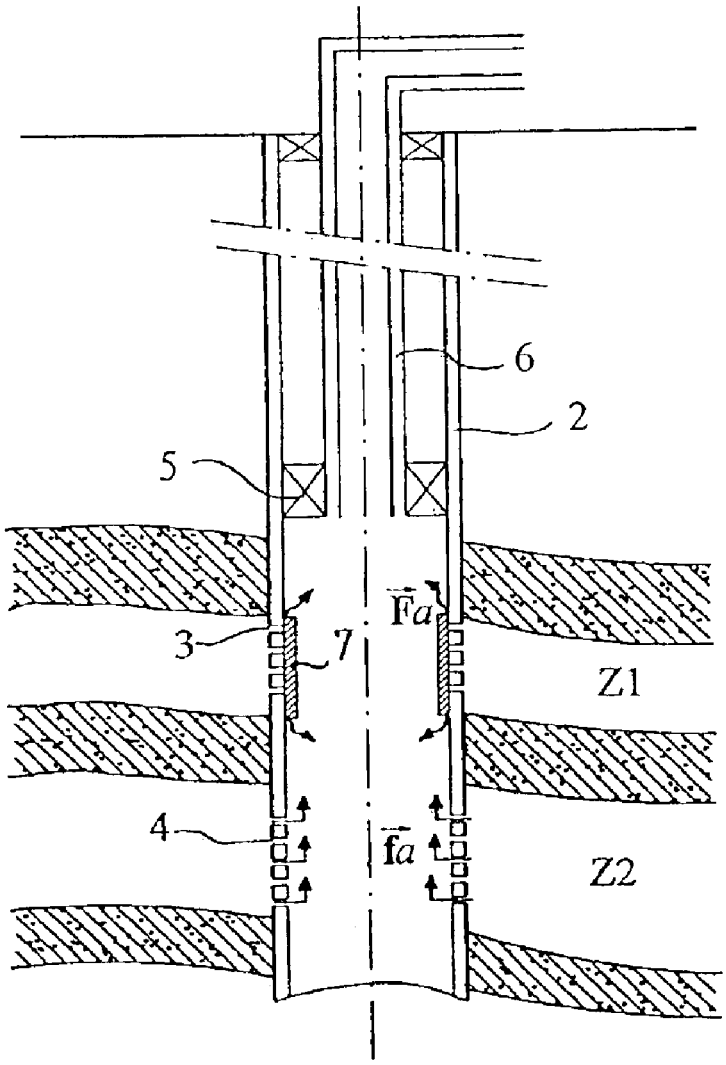
FIG. 2 is a diagrammatic view showing the well shown in FIG. 1, after a regulator sleeve of the invention has been put in place.

This may be obtained, as shown in FIG. 2, by diverting the flow from the perforations of the zone Z1 so as to lengthen the path followed by the formation fluids, thereby generating head loss. In the example shown, the head loss is formed by placing a tubular sleeve 7 in the zone Z1 and deploying it to apply it intimately against the wall of the well. The tubular sleeve is designed so that "leakage" occurs via at least one of its ends, with the fluids flowing between the inside wall of the casing and the tubular sleeve, so that, after treatment, the zones Z1 and Z2 produce respective flow rates of $\vec{F}_a$ and $\vec{f}_a$.

For example, the flow is obtained by providing removal grooves in the outside face of the sleeve. When the sleeve is provided with an outside face constituted by a skin of resilient material of the rubber type, the grooves can be sculpted by means of tools that are commonly used to re-shape the treads of used tires.

Assuming that the formation fluid has a relative density of 0.81, and a dynamic viscosity of 0.005 Pa.s, then it can be shown that four drains, each of which has a width of 4 mm, a depth of 3.5 mm, and a length of 1 m, make it possible to generate a pressure drop of about 50 psi (0.35 MPa) in said zone Z1, and that this pressure drop is proportional to drain length, and inversely-proportional to the number of the drains.

By reducing the production flow rate from the zone Z1 to about 100 barrels per day, it is thus possible to increase the pressure differential in the zone Z2, e.g. to about 200 psi (1.4 MPa), which makes it possible to achieve a flow rate for that zone of about 600 barrels per day, thus bringing the total output of oil produced by the well to 440 barrels per day, i.e. increasing it by about 15%, but above all the volume of co-produced water (which needs to be separated from the oil at the surface) is halved, which reduces the cost of producing the barrels of oil considerably.

Figure 3:
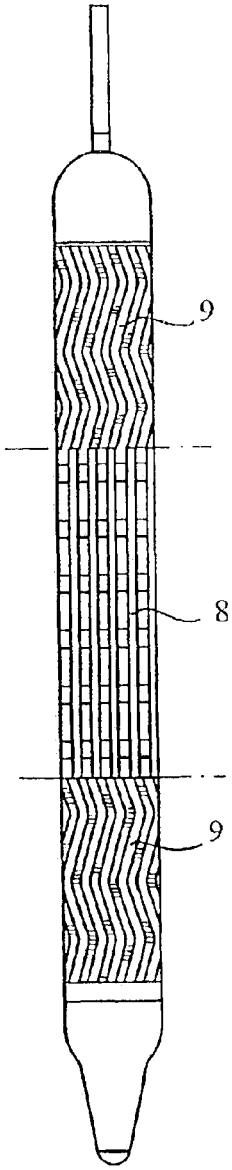
FIG. 3 is a diagrammatic view showing a regulator sleeve of the invention.
Figure 4:
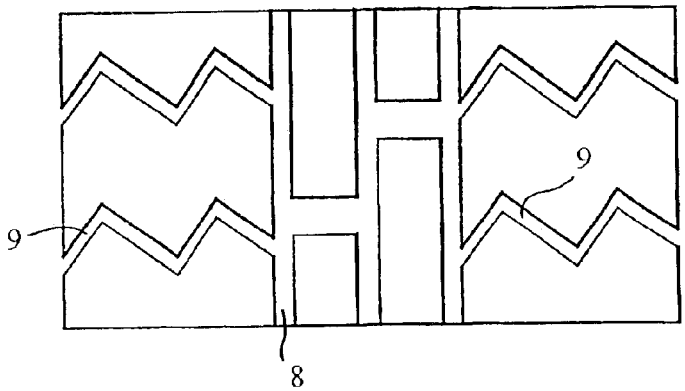
FIG. 4 is a side view in greater detail of the regulator sleeve before it is expanded.

In a more specially preferred variant of the invention described below with reference to FIGS. 3 and 4, the sleeve is provided with two series of grooves: drainage grooves 8 situated in the central portion of the sleeve that serves to cover the perforation zone, and removal grooves 9 situated in at least one of the end zones.

The drainage grooves are of cross-section that is large enough to ensure that the flow of the production fluids is substantially not slowed down. In addition, the grid layout formed by the grooves is preferably dense enough for the removal channels of the end zones to be well irrigated.

Figure 5:
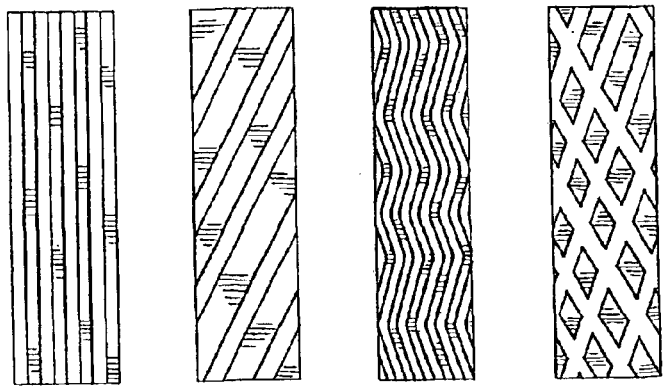
FIG. 5 shows examples of groove profiles.

In the end zones, the grooves are typically smaller, e.g. shallower. FIG. 5 shows a few examples of groove profiles. In the simplest variant (FIG. 5A), the grooves are parallel to the longitudinal axis of the sleeve. However, this variant is not preferred if high head loss is desired because it then requires sleeves that are very long and therefore more costly.

The groove profiles shown in FIGS. 5B and 5D are other more specially preferred variants: helical variants (FIG. 5B), grooves forming zigzag lines (FIG. 5C), or crisscross grooves, e.g. of the crisscross helical groove type (FIG. 5D).

The shaped face is carried by a sleeve which, in its non radially expanded form, must have a radial section that is smaller than the section of the casing, and preferably even smaller than the section of the production tubing, thereby making it possible to perform the treatment of the invention without prior removal of the production tubing. That is why the sleeve is preferably a variant of the sleeve taught by Patent Application WO 94/25655, the contents of which is incorporated herein by reference. The sleeve is thus preferably constituted by a tubular structure provided with a jacket formed by interlacing flat strands or tapes that are helically wound and embedded in a thermo-settable resin, and confined between two resilient membranes made of an elastomer material, the outer membrane forming the skin in which the drainage grooves of the invention are sculpted. For example, the strands may be formed of glass fibers, or preferably of carbon fibers. Preferably, the outside face of the outer skin is provided with a certain number of annular projections to facilitate good contact with the casing.

Figure 6:
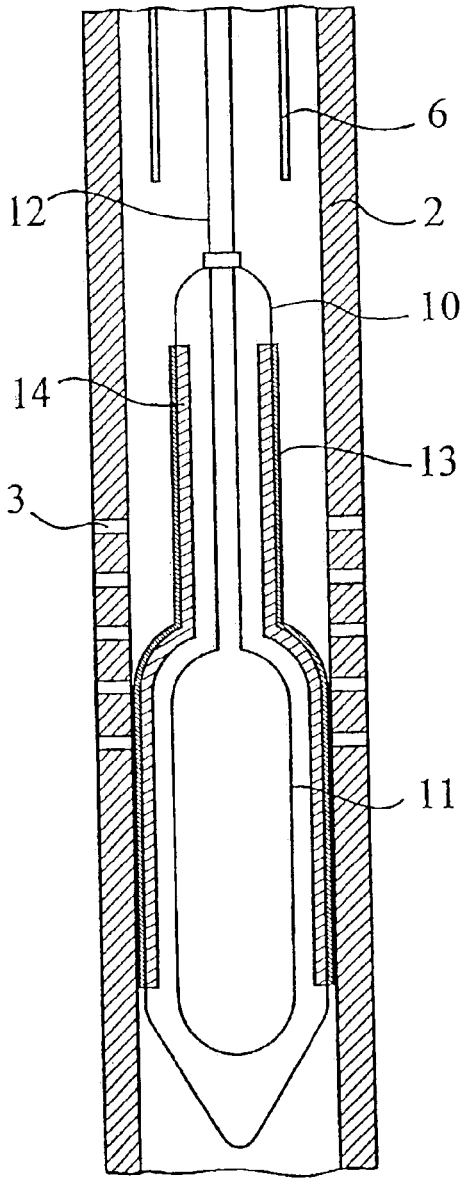
FIGS. 6 and 7 are diagrams showing how the regulator sleeve of the invention is put in place.
Figure 7:
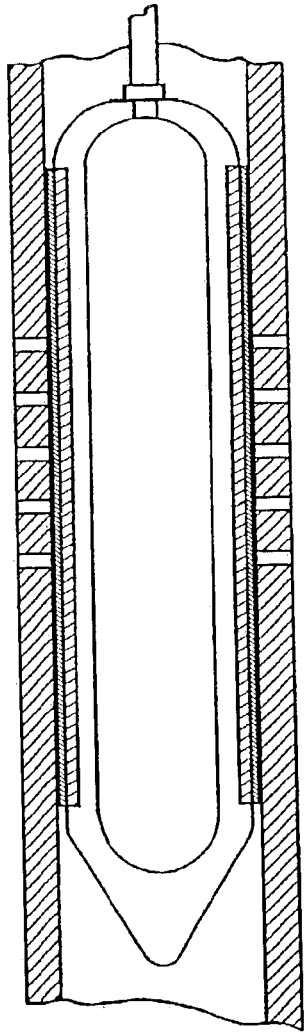

FIGS. 6 and 7 show the operation of putting the sleeve of the invention in place. Firstly, the sleeve, while not expanded radially, is inserted into the well via the production tubing so as to be placed in the vicinity of the zone having the perforations 3 to be treated. For this purpose, the sleeve is associated with a laying tool. The laying tool is essentially constituted by a die 10 having an inflatable element 11 suspended from a cable 12 containing electricity feed means and pumping means for inflating and deflating the die by means of the surrounding fluids. The die is provided with a series of resistor elements (not shown). The grooved outside skin 13 of the sleeve and its inside portion 14 constituted by the braid embedded in the resin are shown, and the sleeve is fixed to the die by breakable link elements.

After positioning, the pump is started, and the die is gradually inflated to anchor it against the wall of the casing, starting from the bottom upwards so as to expel any fluid present between the casing and the sleeve. The radial expansion is thus achieved by deforming the braided portion so that the sleeve is applied intimately against the casing. Once the die and the sleeve have been fully deployed, an electric current is applied to the resistor elements of the die to heat the thermo-settable resin of the sleeve, thereby causing it to polymerize. Once the resin has been set in this way, the pump is used to deflate the die so that the die and the sleeve come apart after traction on the cable to break the breakable link elements. The laying tool can then be brought back up to the surface.

What is claimed is:

1. A method of regulating the flow rate of formation fluids produced from a determined zone of an underground well whose cased wall is provided with orifices through which said formation fluids can pass, said method consisting in applying a tubular structure along the casing in said zone, which tubular structure prevents the fluids from flowing directly while also preserving a flow path along which the fluids can flow via the annular space outside the tubular structure so as to generate head loss, wherein the tubular structure is deployed against the wall of the well such that formation fluids flow between the inner wall of the casing and the tubular structure.

2. A method according to claim 1, in which said path is helical.

3. A device for regulating the flow rate of formation fluids produced from a determined zone of an underground well whose wall is cased with casing provided with perforation orifices to allow said formation fluids to pass through it, said device being constituted by a radially-expandable tubular structure that can be applied against the inside wall of the casing, the structure being provided with means for preserving the flow of the fluids via a path running along the casing and along the structure, in order to generate head loss.

4. A device according to claim 3, characterized in that said flow means are constituted by removal grooves extending from the central portion of the outside face of the tubular structure to at least one of the ends of the tubular structure.

5. A device according to claim 4, characterized in that said removal grooves are disposed helically.

6. A device according to claim 4, characterized in that said removal grooves are disposed in the form of zigzag lines.

7. A device according to any one of claims 3 to 6, in which, in its central portion serving to cover the perforation zone, a tubular sleeve is provided with draining grooves for collecting the incoming flow.

8. A device according to any one of claims 3 to 6, in which the tubular sleeve is constituted by a braid of flexible strands embedded in a settable composite material, and, on its outside face, it has an elastomer skin in which the removal and drainage grooves are provided.

9. A method for putting the device according to claim 8 in place in a well equipped with casing and with production tubing, said method comprising: inserting a laying tool via the casing, which tool comprises an inflatable die provided with heater elements and covered with the tubular sleeve, which die is suspended from a cable containing electricity feed means and pumping means; inflating the die until the sleeve is applied against the inside wall of the casing; heating the die to polymerize the settable composite material; deflating the die while leaving the sleeve in place; and removing the laying tool from the well.

* * * * *